US008479553B2

(12) United States Patent
Yang

(10) Patent No.: US 8,479,553 B2
(45) Date of Patent: Jul. 9, 2013

(54) METHOD FOR FABRICATING WINGS OF BICYCLE PEDALS

(75) Inventor: Tung-Chu Yang, Taipei County (TW)

(73) Assignee: Jia Tsun Industrial Co., Ltd., Taipei County (TW)

( * ) Notice: Subject to any disclaimer, the term of this patent is extended or adjusted under 35 U.S.C. 154(b) by 301 days.

(21) Appl. No.: 12/904,797

(22) Filed: Oct. 14, 2010

(65) Prior Publication Data

US 2012/0090374 A1 Apr. 19, 2012

(51) Int. Cl.
*B21D 22/21* (2006.01)
*B21D 31/00* (2006.01)

(52) U.S. Cl.
USPC ..... 72/347; 72/379.2

(58) Field of Classification Search
USPC ..... 72/379.2, 347, 350, 386, 325, 326, 72/332, 333, 335
See application file for complete search history.

(56) References Cited

U.S. PATENT DOCUMENTS

| | | | | |
|---|---|---|---|---|
| 6,851,189 | B2 | 2/2005 | Hermansen et al. | |
| 7,225,703 | B2 * | 6/2007 | Winefordner et al. | 74/594.4 |
| 7,836,860 | B2 * | 11/2010 | Edgar | 123/90.39 |
| 2006/0143912 | A1 * | 7/2006 | Kamiji et al. | 29/888.2 |
| 2008/0180894 | A1 * | 7/2008 | Yokawa | 361/681 |
| 2010/0018276 | A1 * | 1/2010 | Edelmayer | 72/341 |

* cited by examiner

*Primary Examiner* — Dana Ross
*Assistant Examiner* — Lawrence Averick
(74) *Attorney, Agent, or Firm* — Muncy, Geissler, Olds & Lowe, PLLC

(57) ABSTRACT

A method for fabricating wings of bicycle pedals includes, first, stamping a plate to form a preformed body which includes an opening and a body with a preset working surface. The working surface has a preset force receiving zone. The body has a first expanded portion and a second expanded portion and two arched portions bridging two sides of the first and second expanded portions; then applying a punching force to the force receiving zone to bend the first expanded portion, second expanded portion and arched portions to become a product; finally performing a bending process and a hole forming process on the product to obtain the wings.

7 Claims, 9 Drawing Sheets

METHOD FOR FABRICATING WINGS OF BICYCLE PEDALS

FIELD OF THE INVENTION

The present invention relates to a method for fabricating wings of bicycle pedals and particularly to a method to fabricate wings of bicycle pedals in an integrated fashion.

BACKGROUND OF THE INVENTION

In recent years bicycle becomes very popular and is widely used as transportation means, means for exercise and physical fitness, or leisure and sightseeing activities, either in cities or country sites. It also has been designated as one of sport contest or extreme sport items long time ago. With increasingly popularity of bicycle sports, bicycle users, whether general users, professionals or athletes, have higher demands on nearly every bicycle feature, such as maneuverability, user-friendliness of operation interface or riding comfort. To meet these requirements many types of accessories have been developed for mountain bikes or road bikes. One of them aims to improve treading efficiency of users by providing a coupling system to hold bicycle shoe and pedal together.

For instance, U.S. Pat. No. 7,225,703 discloses a bicycle pedal and crank apparatus. It mainly includes a clipless bicycle pedal and a crank arm. The clipless pedal includes a shaft, a wing, a body and a spring. The wing, body and spring are coupled on the shaft. The wing and spring are held in the body. The spring is located in the wing. The shaft has one end coupled with a sleeve fastened through a screw, and other end coupled with the crank arm through a screw ring. The screw ring holds a bearing inside. A user can latch a shoe cleat at the bottom of the bicycle shoe in the wing (or body). When the user rides the bicycle the cleat is tightly coupled with the wing, and is not easy to separate therefrom. When releasing of the cleat is desired, the cleat has to be positioned at a specific angle with the wing. Such a design allows the bicycle shoe to form a secure coupling with the pedal, hence user's stepping force can be transmitted to the crank more efficiently. Treading also is more stable.

To fabricate the aforesaid wing (or body), U.S. Pat. No. 6,851,189 discloses a method of fabrication a clipless bicycle pedal. A metal plate is stamped to form a flat inner wing and outer wing element. The wing element includes a pair of annular portions each has a spindle hole, and two ends formed respectively a tab and a groove formed in shapes complemented with each other. The wing then is bent in a rectangular structure with a plurality of bend portions. Finally the tab and groove are soldered or brazed together to become a joint.

The aforesaid conventional joining process to fabricate the wing forms a joining interface which has strength far smaller than the wing body. During the joining process a slight negligence of control parameters could result in defective joining interface. Hence when the wing receives continuous treading force of the user for a long duration, or the treading force is inadvertently greater, stress concentration is easily formed on the joining interface and results in fracture. This is especially likely to take place during contests or exercises that require high speed riding. The unstable structural strength on such a pedal system creates safety concern for the user during riding. Moreover, the aforesaid fabrication method is difficult to control structural uniformity during joining of the joining interface between the tab and groove. Production yield could drop and production cost is higher.

SUMMARY OF THE INVENTION

The primary object of the present invention is to solve the problem that the conventional method for fabricating wings of bicycle pedals employing soldering or brazing process results in deficiency of structural strength.

To achieve the foregoing object the present invention provides a method for fabricating wings of bicycle pedals that includes the following steps:

stamping a plate to form a preformed body which includes an opening and a body surrounding the opening that contains a preset working surface formed thereon. The working surface has a preset force receiving zone adjacent to the opening. The body further includes a first expanded portion, a second expanded portion and two arched portions bridging two sides of the first and second expanded portions respectively; and applying a punching force to the force receiving zone to bend the first expanded portion, second expanded portion and arched portions such that the working surface on the first and second expanded portions to be opposite each other and the working surface on the arched portions to be formed in a curved surface opposing each other.

In an embodiment of the present invention, before applying the punching force the preformed body is positioned between an upper mold and a lower mold that clamp an edge portion of the body. When applying the punching force the upper mold escapes the edge portion of the body so that the first expanded portion, second expanded portion and arched portions can be bent between the upper and lower molds.

The fabrication method of the present invention set forth above provides many benefits over the conventional techniques, notably:

1. The wings are manufactured in an integrated manner without forming the joining interface, hence the strength of the wings increases significantly and safety of users during riding is enhanced and the lifespan of the wings is longer.

2. The present invention employs mechanical process to replace soldering or brazing process in the conventional techniques, and can directly form a desired profile through deformation under forces rather than joining through chemical reactions in the conventional techniques, thus can greatly reduce duration of manufacturing the wings and improve production efficiency.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENT

Figure 1A:
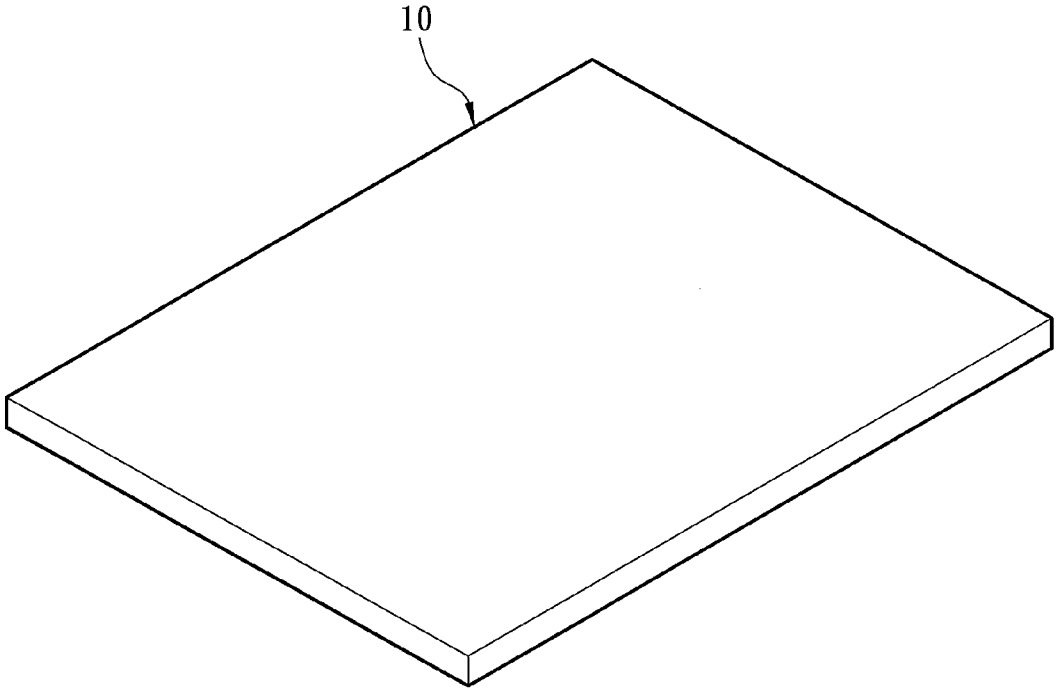
FIGS. 1A through 1E are schematic views of process steps of an embodiment of the method for fabrication wings of bicycle pedals according to the present invention.
Figure 1B:
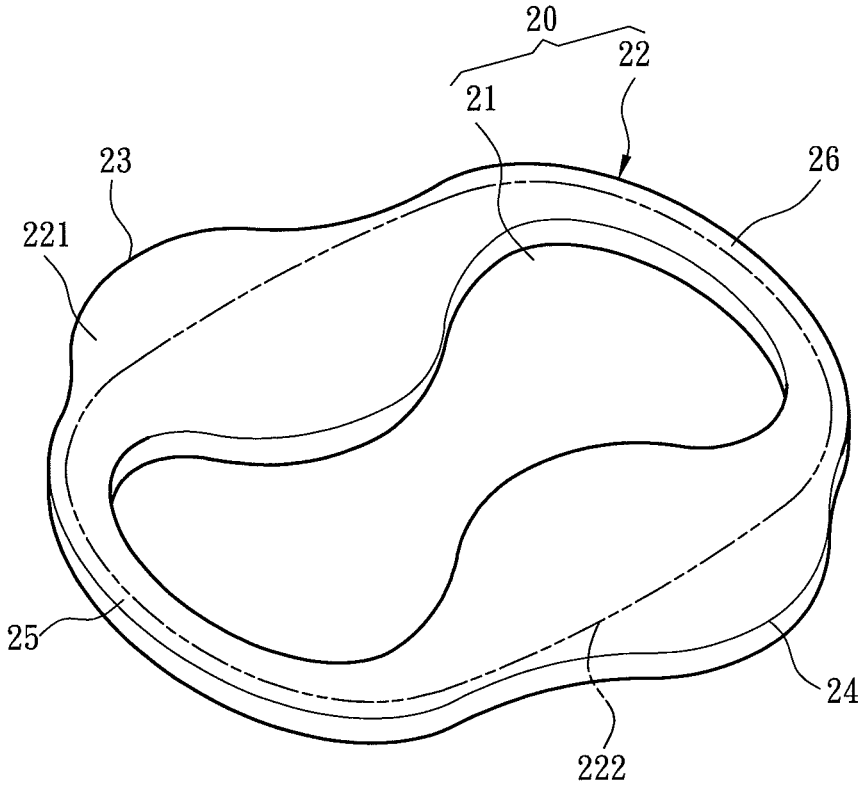

Please refer to FIGS. 1A through 1E for an embodiment of the method for fabricating wings of bicycle pedals according to the present invention. First, a plate 10 is provided, which may be a stainless steel plate, a cold-rolled steel plate, a hot-rolled steel plate or a titanium alloy plate. The titanium alloy plate may include aluminum, vanadium or the like. Then the plate 10 is stamped to obtain a preformed body 20 as shown in FIG. 1B that has an opening 21 and a body 22 surrounding the opening 21. The body 22 has a preset working surface 221 which has a preset force receiving zone 222. In this embodiment the force receiving surface 222 is adjacent to the opening 21.

Figure 1C:
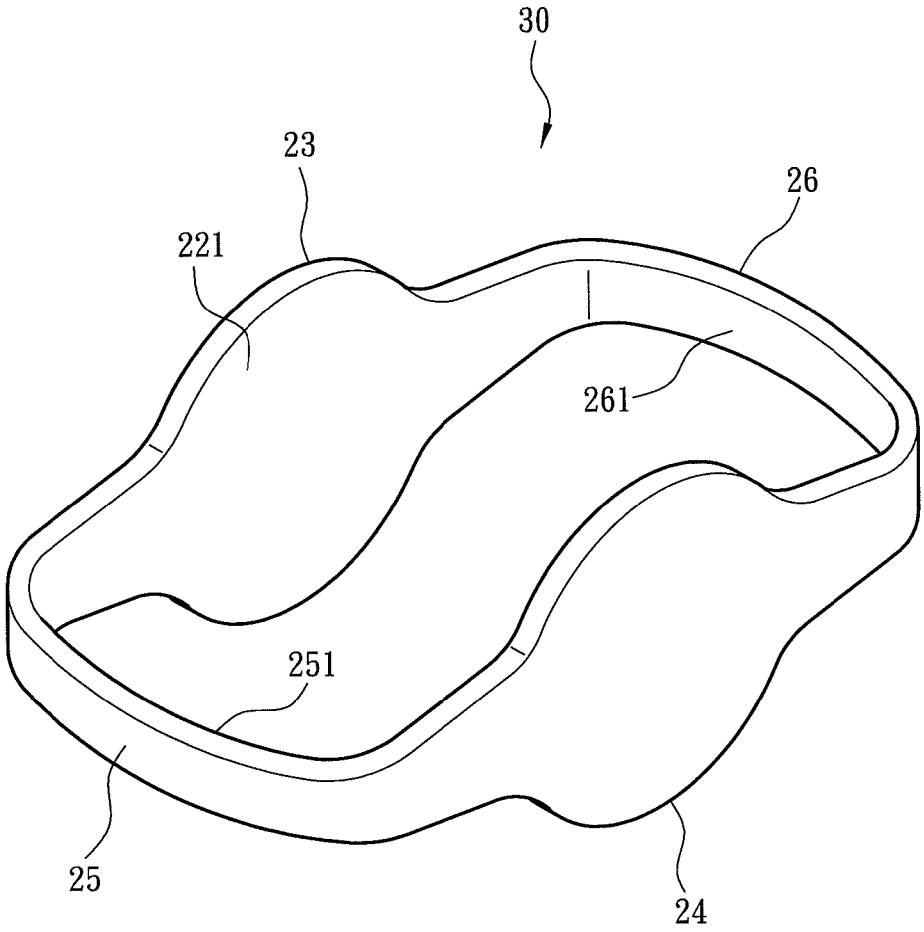

Referring to FIG. 1B, the body 22 further includes a first expanded portion 23, a second expanded portion 24 and two arched portions 25 and 26. The arched portions 25 and 26 connect to two sides of the first and second expanded portions 23 and 24 respectively. The arched portion 25 has two ends connecting respectively to one side of the first and second expanded portions 23 and 24, and the arched portion 26 also have two ends connecting respectively to another side of the first and second expanded portions 23 and 24. Then the force receiving zone 222 is applied with a punching force such that the first expanded portion 23, second expanded portion 24 and arched portions 25 and 26 are bent, and the preformed body 20 is shaped into a product 30 as shown in FIG. 1C, with the working surface 221 on the first and second expanded portions 23 and 24 opposing each other. And the working surface 221 on the arched portions 25 and 26 are formed in curved surfaces 251 and 261 opposing each other after bending.

Figure 1D:
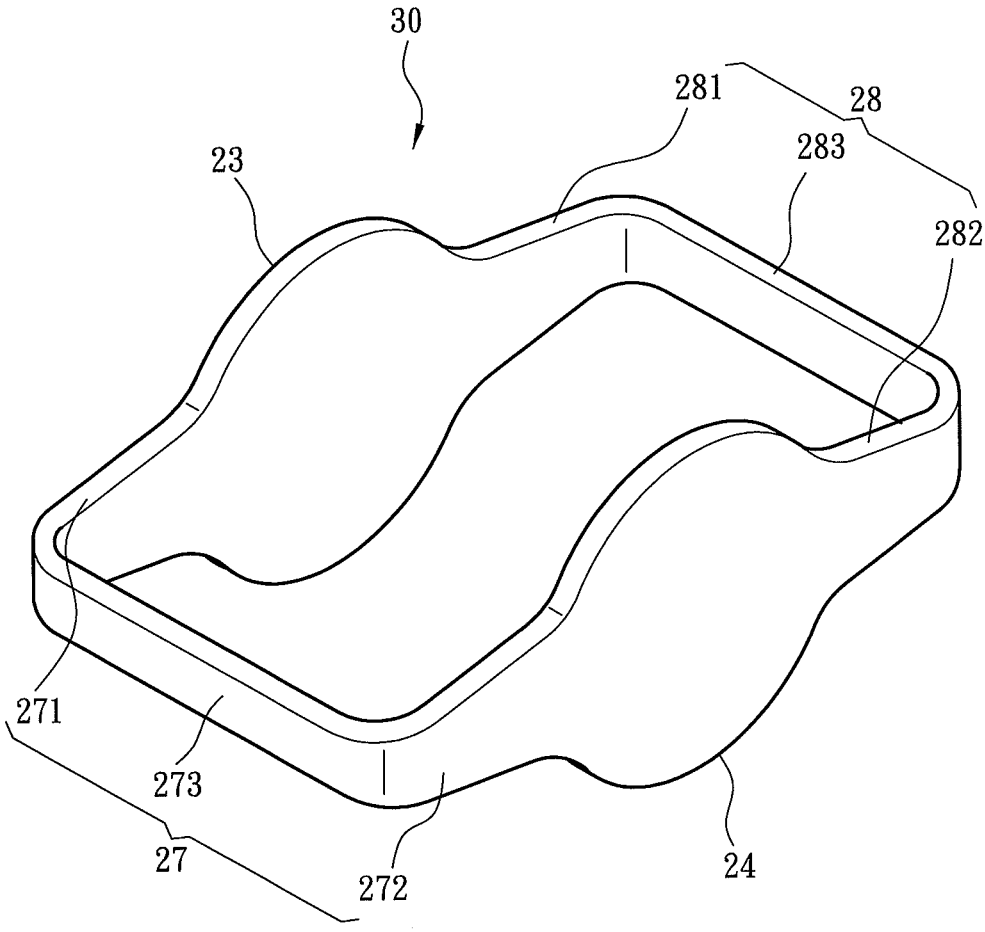

Next, proceed a bending step, referring to FIG. 1D, by bending the arched portions 25 and 26 into first and second vaulted portions 27 and 28. The first vaulted portion 27 includes a first sloped section 271, a second sloped section 272 and a straight section 273. Similarly, the second vaulted portion 28 also includes a first sloped section 281, a second sloped section 282 and a straight section 283. The first sloped sections 271 and 281 are connected to the first expanded portion 23 and form a tilt angle therewith. The second sloped sections 272 and 282 are connected to the second expanded portion 24 and form another tilt angle therewith. The straight sections 273 and 283 bridge respectively the first sloped sections 271 and 281, and second sloped sections 272 and 282. The tilt angles may be adjusted according to the desired shape of the wings. Moreover, the bending process may also be accomplished by stamping or other equivalent mechanical processes.

Figure 1E:
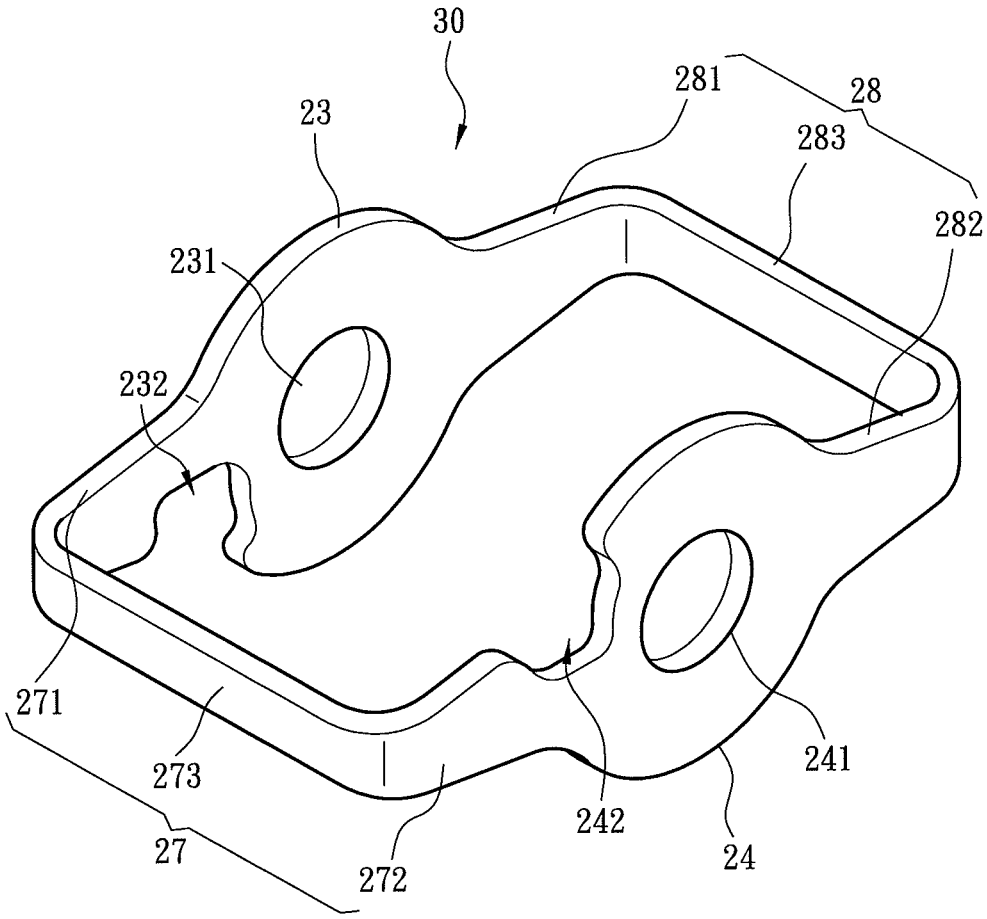

Referring to FIG. 1E, after the bending process is finished, proceed a hole forming process to obtain the finished product of the wing. This is accomplished by stamping center and peripheral portions of the first and second expanded portions 23 and 24 at the same time to form a first axle hole 231 and a second axle hole 241 on the center portions, and a first notch 232 and a second notch 242 on the peripheral portions thereof. The first axle hole 231 and second axle hole 241 are coaxial. According to actual requirement, while the first axle hole 231, second axle hole 241 and first and second notches 232 and 242 may be formed by stamping at the same time, another alternative may also be adopted by forming the first and second axle holes 231 and 241 first, or forming the first and second notches 232 and 242 first. Aside from the fabrication sequence previously discussed, the hole forming process may also be performed prior to the bending process.

In this embodiment the force receiving zone 222 is applied with the punching force through a stamping equipment. Please refer to FIGS. 2A through 2D for an embodiment of the method for fabrication wings of bicycle pedals according to the present invention employing the stamping equipment to shape a preformed body into a product. The stamping equipment includes an upper mold set 40 and a lower mold set 50 that have respectively an upper mold 41 and a lower mold 51, and holes 42 and 52 run through the upper and lower molds 41 and 51 respectively. The upper mold 41 further has a stamping head 43 accommodated in the hole 42 which is movable up and down relative to the upper mold 41. The lower mold 51 has two lower troughs 511 on two opposite side walls corresponding to the first and second expanded portions 23 and 24 of the body 22. The upper mold 41 also has two upper troughs 411 on two opposite side walls corresponding to the first and second expanded portions 23 and 24.

Figure 2A:
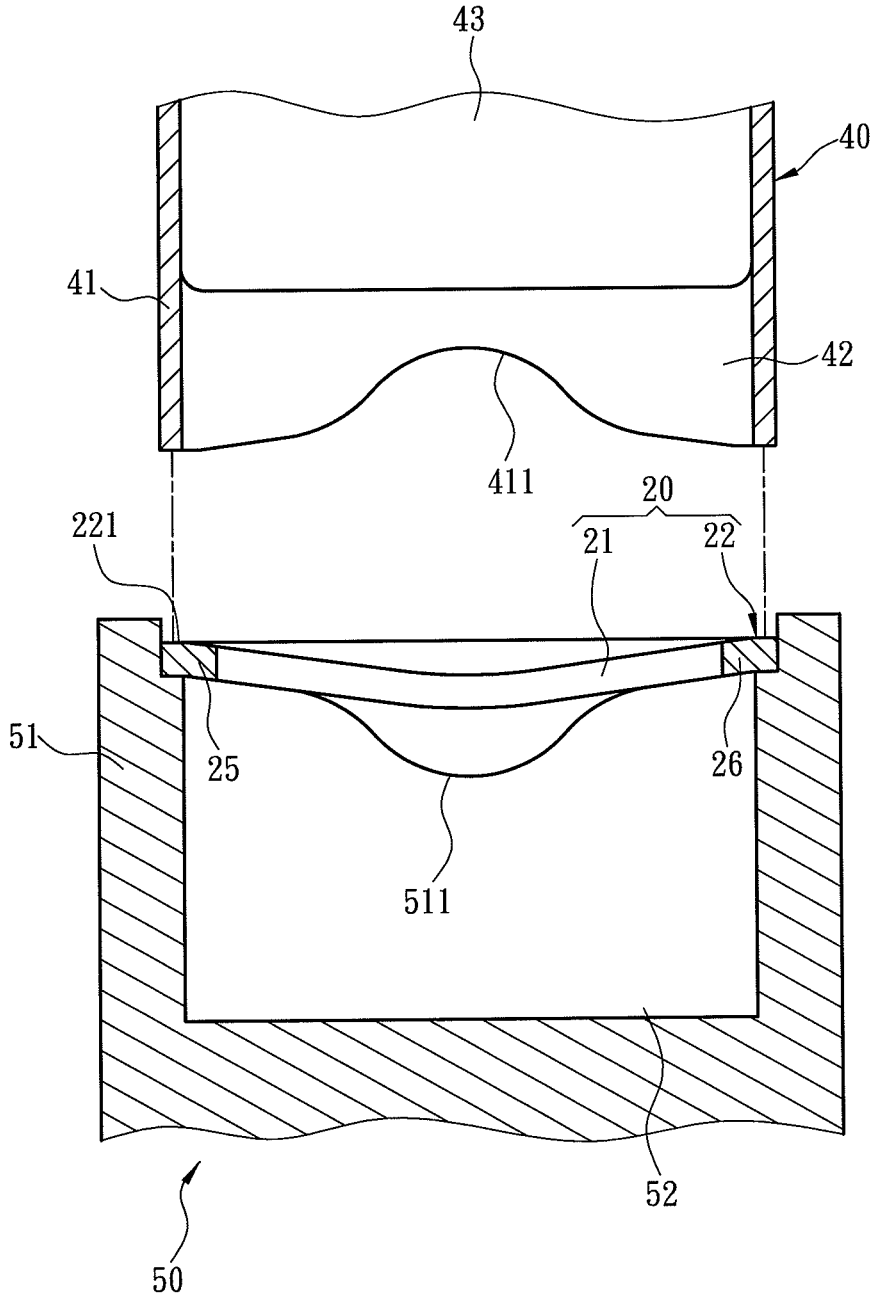
FIGS. 2A through 2D are schematic views of process steps of an embodiment of the method for fabrication wings of bicycle pedals according to the present invention employing the stamping equipment to shape a preformed body into a product.
Figure 2B:
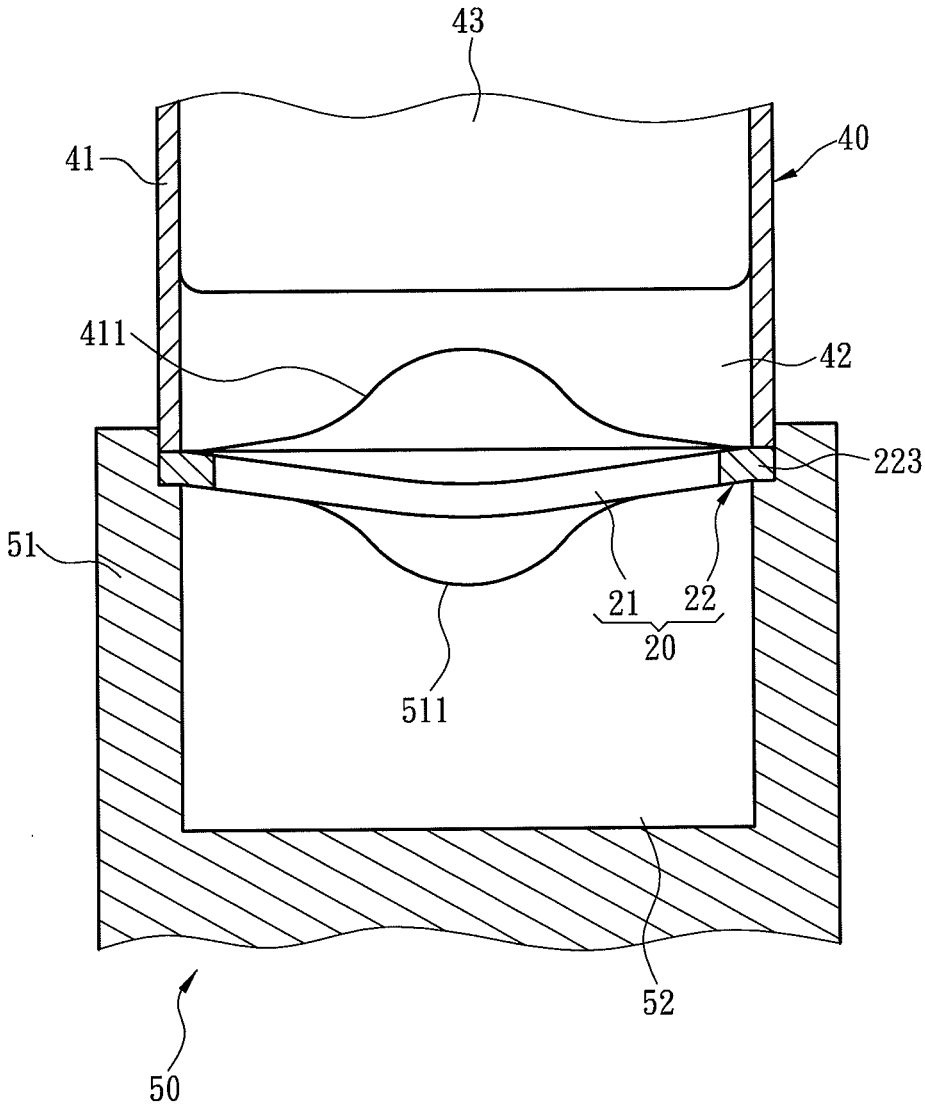

Referring to FIG. 2A, the body 22 is formed in a concave shape since the preformed body 20 is manufactured by stamping the plate 10 to form the opening 21. Namely, an elevation difference is existed between the outer edge and inner edge of the body 22 so that the working surface 221 is formed as a curved surface. Before applying the punching force, as shown in FIG. 2A, the preformed body 20 is placed in advance on the lower mold set 50 and then positioned between the upper mold 41 and lower mold 51. The upper mold 41 is moved downwards close to the lower mold set 50 at an anchoring position as shown in FIG. 2B. The upper mold 41 is in contact with an edge portion 223 of the body 21 such that the edge portion 223 is clamped by the upper mold 41 and the lower mold 51.

Figure 2C:
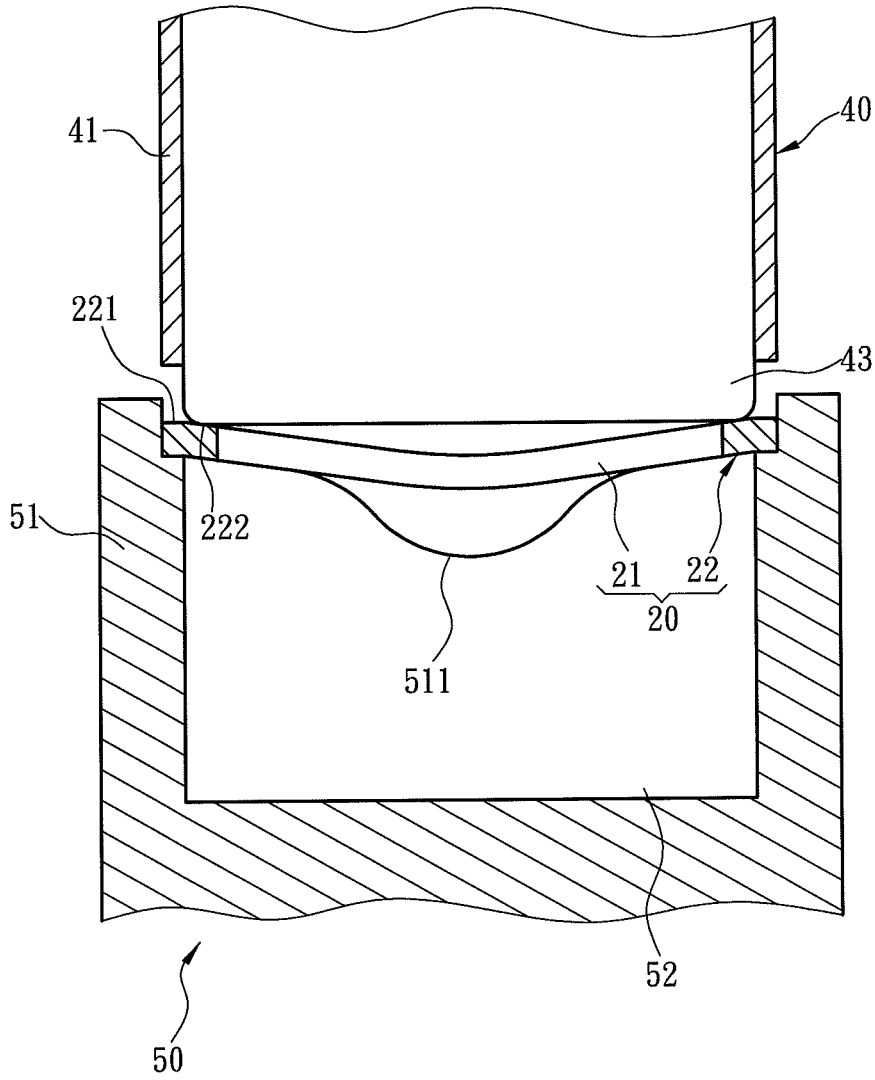
Figure 2D:
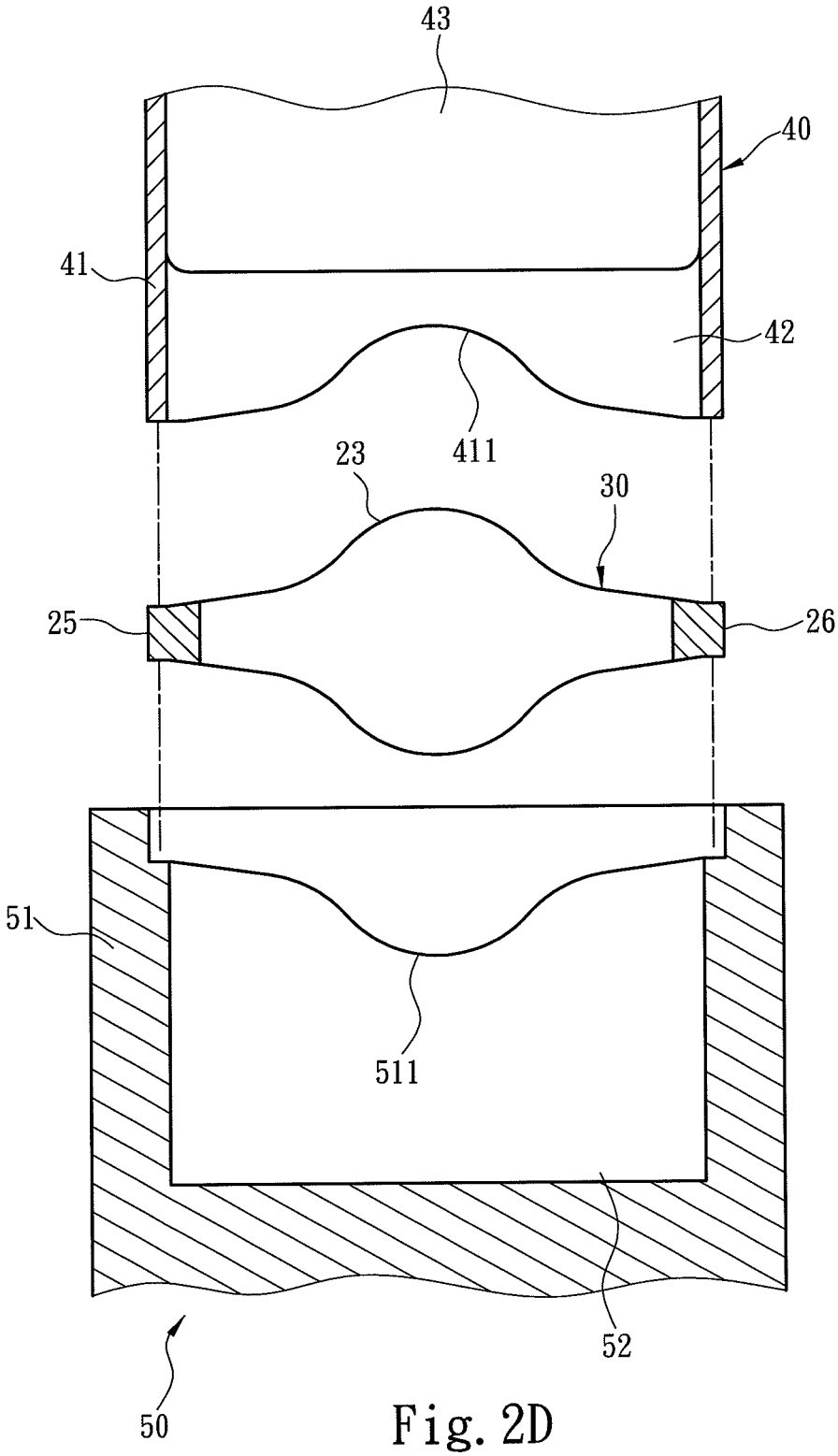

With the preformed body 20 positioned between the upper mold 41 and lower mold 51, move the stamping head 43 to apply the punching force on the force receiving zone 222, meanwhile the upper mold 41 is moved upwards and escapes the edge portion 223 as shown in FIG. 2C to be in a stamping position such that the upper mold 41 is no longer in contact with the edge portion 223, therefore the first expanded portion 23 and second expanded portion 24 and arched portions 25 and 26 receive the punching force and are bent for ninety degrees and deformed in a gap between the upper mold 41 and lower mold 51 to shape into the product 30. Finally, the product 30 is removed from the upper mold set 40 and lower mold set 50 as shown in FIG. 1C. In this embodiment the troughs 411 and 511 are formed in shapes to be complementary with the first and second expanded portions 23 and 24.

As a conclusion, the method for fabricating wings of bicycle pedals provided by the present invention manufactures the wings in an integrated manner through mechanical processes. Compared with the conventional techniques of adopting soldering or brazing process, the wings formed by the present invention do not have joining interfaces. Hence the structural strength of the wings increases significantly and the life span also lengthens. It also improves safety when in use. Besides, the steps in the fabrication process provided by present invention can all be achieved by stamping, thus is simplified and can make production faster at a lower cost.

While the preferred embodiment of the present invention has been set forth for the purpose of disclosure, modifications of the disclosed embodiment of the present invention as well as other embodiments thereof may occur to those skilled in the art. Accordingly, the appended claims are intended to cover all embodiments which do not depart from the spirit and scope of the present invention.

What is claimed is:

1. A method for fabricating wings of bicycle pedals, comprising the steps of:

stamping a plate to form a preformed body which includes an opening and a body surrounding the opening that contains a preset working surface, the working surface including a preset force receiving zone adjacent to the opening, the body further containing a first expanded portion, a second expanded portion and two arched portions bridging two sides of the first and second expanded portions respectively, wherein the first expanded portion, second expanded portion and two arched portions are on a same horizontal plane;

applying a punching force to the force receiving zone to bend the first expanded portion, the second expanded portion and the arched portions such that the working surface on the first and second expanded portions to be opposite each other and the working surface on the arched portions are formed in curved surfaces opposing each other; and bending the arched portions to form vaulted portions, wherein each of the vaulted portions containing a first sloped section connecting to the first expanded portion, a second sloped section connecting to the second expanded portion and a straight section bridging the first sloped section and the second sloped section.

2. The method of claim 1, wherein the preformed body is positioned between an upper mold and a lower mold before applying the punching force, and the upper mold and the lower mold clamping an edge portion of the body.

3. The method of claim 2, wherein the upper mold escapes the edge portion of the body when applying the punching force so that the first expanded portion, the second expanded portion and the arched portions are bent between the upper mold and the lower mold.

4. The method of claim 1, wherein the arched portions are bent to form vaulted portions after applying the punching force, each of the vaulted portions containing a first sloped section connecting to the first expanded portion, a second sloped section connecting to the second expanded portion and a straight section bridging the first sloped section and the second sloped section.

5. The method of claim 1, wherein after applying the punching force the first expanded portion and the second expanded portion are stamped to form respectively a first axle hole and a second axle hole that are coaxial.

6. The method of claim 1, wherein after applying the punching force the first expanded portion and the second expanded portion are stamped on a peripheral portion thereof to form respectively a first notch and a second notch.

7. The method of claim 1, wherein the plate is selected from the group consisting of a stainless steel plate, a cold-rolled steel plate, a hot-rolled steel plate and a titanium alloy plate.

* * * * *